US011378353B2

(12) United States Patent
Malheiros et al.

(10) Patent No.: US 11,378,353 B2
(45) **Date of Patent: *Jul. 5, 2022**

(54) ARROW GUN WITH CONTROLLED RETENTION FORCE AND BARREL VIBRATION DAMPING

(71) Applicant: Crosman Corporation, Bloomfield, NY (US)

(72) Inventors: George Wallace Rodrigues Malheiros, Victor, NY (US); David C. Snyder, Macedon, NY (US); Anthony Thomas Cioppa, Rochester, NY (US); Justin Heckert, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/101,409

(22) Filed: Nov. 23, 2020

(65) Prior Publication Data

US 2021/0140737 A1 May 13, 2021

Related U.S. Application Data

(63) Continuation of application No. 16/565,211, filed on Sep. 9, 2019, now Pat. No. 10,845,155, which is a continuation of application No. 15/943,040, filed on Apr. 2, 2018, now Pat. No. 10,408,564, which is a continuation of application No. 14/801,047, filed on Jul. 16, 2015, now Pat. No. 9,933,231.

(51) Int. Cl.
*F41B 11/83* (2013.01)
*F41B 11/723* (2013.01)
*F41B 11/62* (2013.01)

(52) U.S. Cl.
CPC ..... *F41B 11/83* (2013.01); *F41B 11/62* (2013.01); *F41B 11/723* (2013.01)

(58) Field of Classification Search
CPC ..... F41B 11/83; F41B 11/62; F41B 11/723
USPC ..... 124/71, 73, 25, 61, 22; 42/51
See application file for complete search history.

(56) References Cited

U.S. PATENT DOCUMENTS 1,683,574 A * 9/1928 Murphy ..... F41B 3/005 124/37
1,691,769 A * 11/1928 Larson ..... F41B 3/005 124/35.1
1,907,273 A * 5/1933 Umling ..... F41B 5/12 124/35.1
2,528,723 A * 11/1950 Hane ..... F41B 7/006 473/578
2,736,308 A * 2/1956 Vilarrubis ..... F41B 11/83 124/63
2,853,992 A * 9/1958 Wheeler ..... F41B 3/02 124/20.3
2,861,560 A * 11/1958 Alinari ..... F41B 11/83 124/75

(Continued)

FOREIGN PATENT DOCUMENTS

EP 2336707 A1 * 6/2011 ..... F41B 11/62

*Primary Examiner* — John Cooper
(74) *Attorney, Agent, or Firm* — Brian B. Shaw; Harter Secrest & Emery LLP

(57) ABSTRACT

An arrow gun is provided having a controllable retention force on the arrow. By setting the retention force on the arrow, increased energy from motive compressed gas can be imparted to the arrow. The arrow gun also includes a damping coupling for reducing vibration of an unsupported length of the barrel.

17 Claims, 3 Drawing Sheets

(56) References Cited

U.S. PATENT DOCUMENTS 2,923,286 A * 2/1960 Draganti ..... F41B 11/83 124/31
2,970,838 A * 2/1961 Taggert ..... F42B 12/64 473/577
3,137,287 A * 6/1964 De Arbun ..... F41B 1/00 473/578
3,194,226 A * 7/1965 Hoff ..... F41B 3/02 124/22
3,324,767 A * 6/1967 Alban ..... F41C 9/06 89/1.7
3,433,210 A * 3/1969 Schnitz ..... F41B 1/00 446/62
3,540,426 A * 11/1970 Hauck ..... F41B 11/50 124/67
3,583,087 A * 6/1971 Huebner ..... F42B 12/68 42/76.01
3,837,107 A * 9/1974 Swaim ..... F41A 19/07 42/105
4,466,417 A * 8/1984 Mulot ..... F41B 7/04 124/80
4,665,885 A * 5/1987 Glomski ..... F41B 7/003 124/37
4,890,597 A * 1/1990 Ekstrom ..... F41B 11/83 124/71
5,086,749 A * 2/1992 Ekstrom ..... F41B 11/83 124/71
5,224,464 A * 7/1993 Burnham ..... F41B 11/642 124/16
5,242,323 A * 9/1993 Rappaport ..... F41B 11/642 124/66
6,017,284 A * 1/2000 Giles ..... F42B 6/06 473/578
6,076,513 A * 6/2000 Doherty ..... F41B 11/642 124/66
7,017,568 B1 * 3/2006 Smith ..... F41B 5/1469 124/25
D584,375 S * 1/2009 Sims ..... D22/108
7,854,221 B1 * 12/2010 Gore ..... F41B 11/642 124/63
7,926,408 B1 * 4/2011 Kley ..... F42B 10/40 89/41.17
8,087,406 B2 * 1/2012 Axelsson ..... F41B 11/62 124/71
9,194,639 B1 * 11/2015 Malheiros ..... F41A 19/12
9,851,173 B2 * 12/2017 Malheiros ..... F41B 11/723
9,933,231 B2 * 4/2018 Malheiros ..... F41B 11/62
10,408,564 B2 * 9/2019 Malheiros ..... F41B 11/62
10,845,155 B2 * 11/2020 Malheiros ..... F41B 11/62
2005/0188979 A1 * 9/2005 Berry ..... F42B 14/064 124/76
2007/0074711 A1 * 4/2007 Gill ..... F41B 11/83 124/20.3
2007/0074712 A1 * 4/2007 Fielding, Jr. ..... F41B 5/12 124/22
2010/0024791 A1 * 2/2010 Romney ..... F41B 5/143 124/56
2010/0212646 A1 * 8/2010 Fielding, Jr. ..... F41B 7/08 124/22
2010/0288254 A1 * 11/2010 Gillet ..... A01K 81/06 124/25
2010/0288256 A1 * 11/2010 Mattos ..... F41B 11/723 124/73
2011/0146646 A1 * 6/2011 Axelsson ..... F41B 11/83 124/71
2012/0210990 A1 * 8/2012 Park ..... F41B 5/0094 124/17
2013/0239938 A1 * 9/2013 Nugent ..... F41B 11/55 124/59
2013/0247887 A1 * 9/2013 Flint ..... F42B 12/56 124/16
2013/0319388 A1 * 12/2013 Schultz ..... F41B 7/00 124/31
2015/0082679 A1 * 3/2015 Michal ..... F41C 23/16 42/71.01
2015/0198407 A1 * 7/2015 Giannelli ..... F41B 11/62 124/76
2015/0260478 A1 * 9/2015 Park ..... F41B 3/005 124/20.3
2015/0354918 A1 * 12/2015 Gore ..... F41B 11/642 124/66
2016/0033231 A1 * 2/2016 Hall ..... F41C 7/11 42/51

* cited by examiner

ARROW GUN WITH CONTROLLED RETENTION FORCE AND BARREL VIBRATION DAMPING

STATEMENT REGARDING FEDERALLY SPONSORED RESEARCH OR DEVELOPMENT

Not applicable.

REFERENCE TO A "SEQUENCE LISTING"

Not applicable.

BACKGROUND

Field of the Invention

The present disclosure relates to arrow guns and particularly to arrow guns using compressed gas to propel the arrow, wherein a retention force on the arrow can be adjusted to increase imparted energy from the compressed gas to the arrow. The present disclosure further relates to reducing vibration of an unsupported length of a barrel, wherein the barrel receives compressed gas to act on the arrow.

Description of Related Art

Compressed gas has been used to propel BBs from a gun for many years. However, the ability to propel an arrow, such as a standard length arrow from a gun by compressed gas has not been well developed. Thus, there exists a need for an improved compressed gas gun capable of projecting an arrow.

The need also exists for a compressed gas gun able to exert a more instantaneous pressure front upon an arrow being propelled to increase the amount of energy imparted to the arrow being propelled.

BRIEF SUMMARY OF THE INVENTION

The present disclosure provides an apparatus for increasing the maximum pressure of compressed gas acting on the arrow.

Propelling an arrow is complicated because the compressed gas must expand and travel through the barrel to contact the arrow, thus a gradually increasing pressure front is exerted upon the arrow. This gradually increasing pressure front causes the arrow to begin moving from the barrel before the maximum pressure exertable by the compressed gas has a chance to act upon the arrow. This gradual increase in pressure significantly reduces the amount of energy able to be transferred to the arrow as the arrow is propelled along the length of the barrel. The reduced pressure results in a significant reduction in muzzle velocities and kinetic energy transferred to the arrow.

The present disclosure provides for a controllable or adjustable retention force on the arrow so that motion of the arrow relative to the barrel is limited during at least a portion of the gradually increasing pressure front of the compressed gas. By increasing the retention force on the arrow, a higher pressure of the compressed gas can act on the arrow. In addition, the present disclosure provides repeatable retention force on the arrow, thus providing subsequent shots with consistent arrow velocity. The present disclosure further provides a damping of barrel vibration, thereby allowing for use of longer barrels and hence greater accuracy and arrow velocity.

In one configuration, an arrow gun using compressed gas to propel an arrow having a hollow portion is provided, wherein the arrow gun includes a receiver; an elongate barrel having a longitudinal axis, the barrel connected to the receiver at a fixed connection, the barrel having an outer diameter sized to be slidably received within the hollow portion of the arrow and terminating at a free end; a damping coupling between the receiver and the barrel, the damping coupling longitudinally spaced along the barrel from the fixed connection to be intermediate the fixed connection and the free end of the barrel; and wherein the barrel has an unsupported length of approximately 12 inches to 36 inches between the damping coupling and the free end.

In a further configuration, an arrow gun using compressed gas to propel an arrow having a hollow portion is provided, wherein the arrow gun includes a barrel sized to be received within the hollow portion of the arrow; a gripping surface having a first configuration exerting a first retention force on the arrow receiving the barrel within the hollow portion and a second configuration exerting a different second retention force on the arrow receiving the barrel within the hollow portion.

BRIEF DESCRIPTION OF THE SEVERAL VIEWS OF THE DRAWING(S)

DETAILED DESCRIPTION OF THE INVENTION

Figure 1:
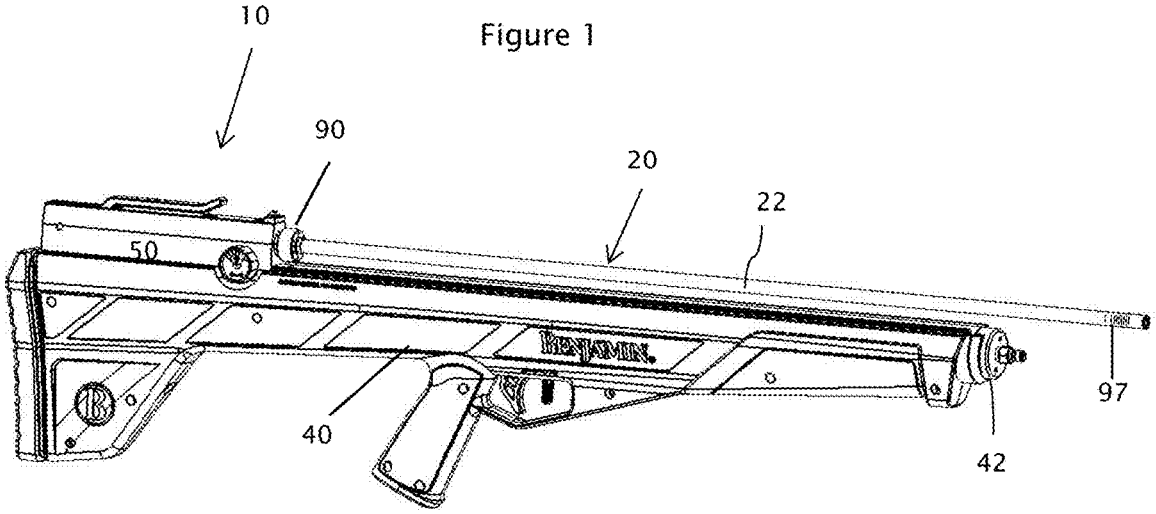
FIG. 1 is a perspective view of a representative arrow gun.
Figure 2:
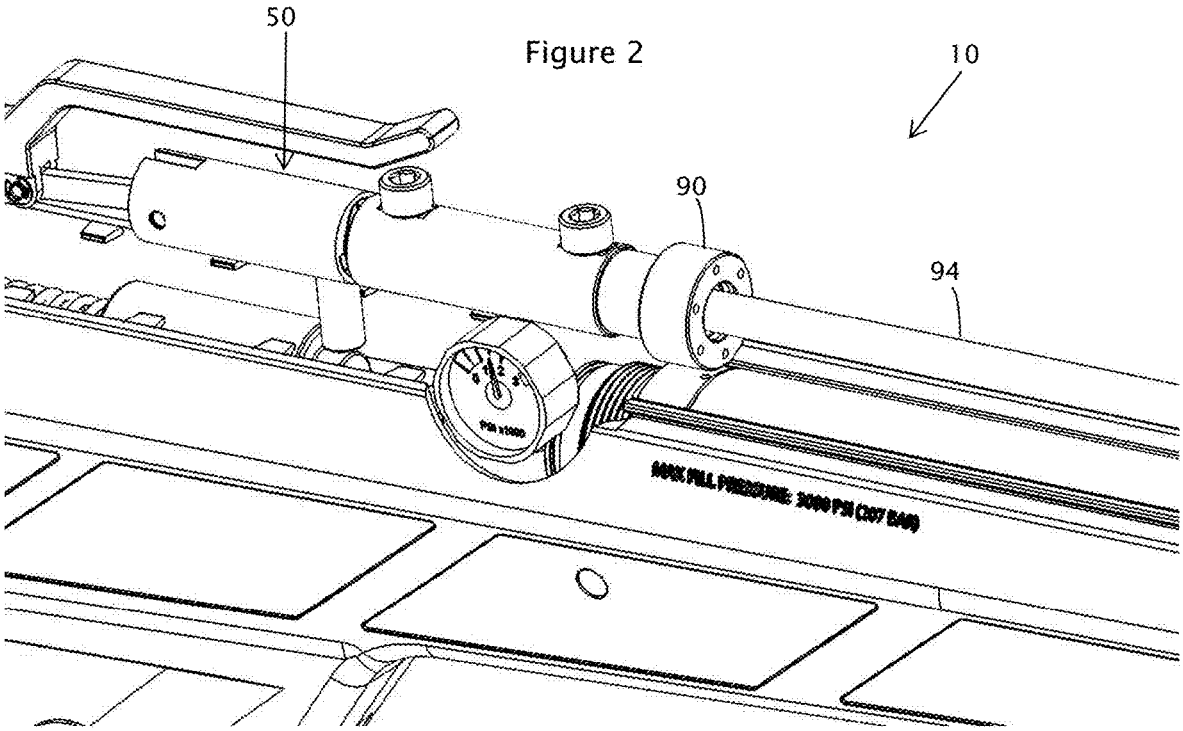
FIG. 2 is an enlarged perspective view of the arrow gun of FIG. 1 showing an unsupported length of the barrel.
Figure 3:
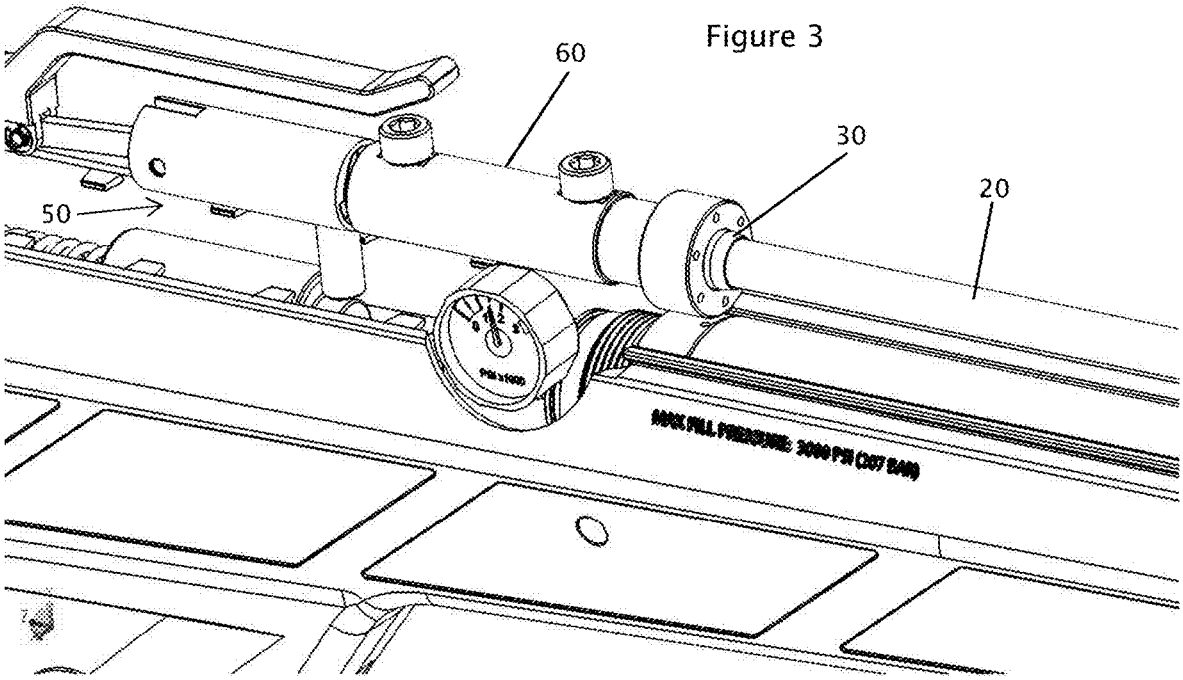
FIG. 3 is an enlarged perspective view of the arrow gun of FIG. 1 showing an arrow loaded on the barrel.

Referring to FIGS. 1 and 2, a pneumatic, or compressed gas gun 10 for propelling an arrow 20 is shown. In one configuration, as seen in FIGS. 1 and 2, the gun 10 includes a stock 40, a receiver 50 and a barrel 94.

The stock 40 can include or retain a reservoir 42 of compressed gas, as well as a trigger assembly and a gas valving system as known in the art. Representative reservoirs, trigger assemblies, and valving systems can operably retain compressed gas at a pressure of 2,000 psi to 7,000 psi, wherein the valving system presents the gas to the receiver 50 and hence the barrel 94 at approximately 500 psi to 5,000 psi.

The receiver 50 cooperatively connects the barrel 94 to the stock 40. As seen in FIGS. 2-5, the receiver includes a barrel adapter 60. The barrel adapter 60 can be integral with the receiver 50 or a component of the receiver. As used herein, the term receiver 50 is taken to include the barrel adapter 60. Thus, the barrel adapter 60 can be understood to be the receiver 50. The barrel adapter 60 includes a receiving recess 63, wherein the barrel receiving recess includes a coupling length (or section) 64 and a control length (or section) 74.

Figure 4:
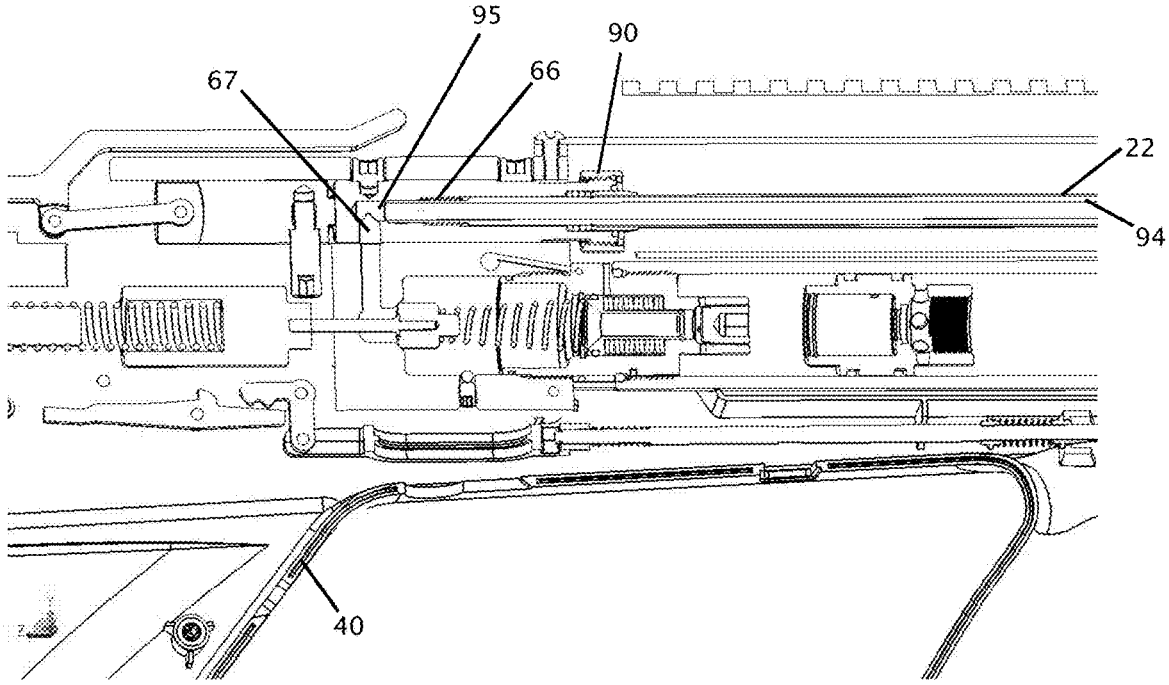
FIG. 4 is a cross sectional view of the arrow gun of FIG. 1.
Figure 5:
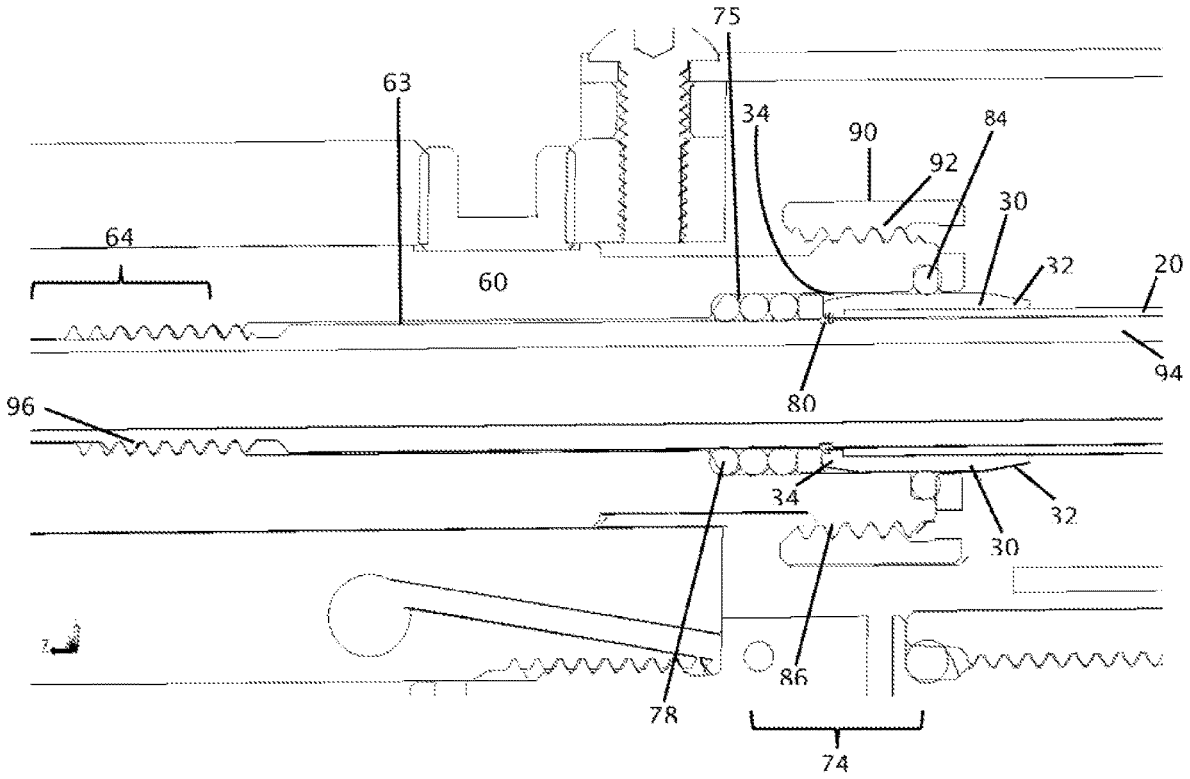
FIG. 5 is an enlarged cross sectional view of the arrow gun of FIG. 1.

The coupling length 64 has a diameter substantially equal to the outer diameter of the barrel 94, to slideably receiving a length of the barrel. Referring to FIGS. 4 and 5, the coupling length 64 also includes a plurality of internal threads 66, such as shown as an internally threaded section.

The control length 74 defines an internal diameter greater than the diameter of the coupling length 64, wherein the diameter is sized to define a damping annulus 75 between an outer surface of the barrel and an inner surface of the control length.

The damping annulus 75 is sized to retain a damping coupling 78 between the outer surface of the barrel and the inner surface of the control length 74 of the barrel adapter 60. The damping coupling 78 can be a variety of materials selected to reduce vibration of the barrel relative to the barrel adapter 60, the receiver 50 and hence the stock 40. The damping coupling 78 can include resilient materials including elastomers, high durometer plastics as well as metals. The damping coupling 78 can include a plurality of O-rings, or be in the form of a sleeve, or a bushing. Thus, the damping coupling 78 can include a compression ring, an O-ring, elastomers, high durometer plastics, such as well as metals, and can have configurations including a plurality of O-rings, or be in the form of a sleeve, or a bushing. As seen in FIG. 5, a locking ring 80 can be used to keep the damping coupling 78 in a fixed position relative to the barrel 94.

In one aspect, the damping coupling 78 is located at a vibrational anti-node of the barrel 94. Thus, depending on the intended length of the barrel 94, the barrel adapter 60 can be configured to locate the damping coupling 78 at the actual or anticipated anti-node, thereby increasing the amount of vibrational energy that is removed from the barrel 94.

An open end of the receiving recess 63 defines a seating groove 83 for receiving a gripping surface 84. The gripping surface 84 can include a compression ring, an O-ring, elastomers, high durometer plastics, as well as metals, and can have configurations including a plurality of O-rings, or be in the form of a sleeve, or a bushing.

An outside surface of the barrel adapter 60 includes a coupling 86 for selectively engaging a collar 90, wherein the collar can be moved longitudinally relative to the barrel adapter and hence the barrel receiving recess 63.

In one configuration, the coupling 86 on the outside surface of the barrel adapter 60 is a plurality of external threads and a corresponding coupling 92 on the collar 90 is a mating plurality of internal threads. Thus, rotation of the collar 90 relative to the barrel adapter 60 changes the longitudinal position of the collar relative to the barrel adapter.

In a first positioning of the collar 90 relative to the barrel adapter 60, the gripping surface 84 (such as the compression ring) projects into the receiving recess 63 a first amount, and in a second positioning of the collar relative to the barrel adapter, the gripping surface (such as the compression ring) projects into the receiving recess a different second amount.

Depending on the selected coupling between the collar 90 and the barrel adapter 60, the amount of force applied to the gripping surface 84 (such as the compression ring), and hence compression of the gripping surface (compression ring) and amount of the gripping surface (compression ring) projecting into the receiving recess 63 can be varied between at least two positions, and up to a multitude of positions, such as by different threaded engagements. The amount of the gripping surface 84 projecting into the receiving recess 63 determines the amount of the retention force on the arrow 20.

It is also contemplated that the gripping surface 84 can be in the form of a cam or inclined surface that varies its position in response to the positioning of the collar 90. That is, an increased or decreased portion of the cam or inclined surface can be located within the retaining recess.

The barrel adapter 60 also includes a gas passageway 67 fluidly connecting a source of compressed gas to the barrel.

The barrel 94 is elongate and sized to be slidably received within the arrow. In one configuration, the barrel extends along a longitudinal axis and has an outer diameter of approximately 0.25 to 0.5 inches. While a wall thickness of the barrel 94 can be partly determined by desired operating characteristics, a satisfactory barrel wall thickness has been found to include approximately 0.020 inches. The barrel 94 can be formed of a variety of materials including, but not limited to composites, laminates, plastics including elastomers and metal. A satisfactory material includes stainless steel or carbon fiber.

The barrel 94 includes a threaded outer surface 96 adjacent one end 95 of the barrel. The wall thickness of the barrel 94 is partly selected to accommodate the external threads 96 for engaging the barrel adapter 60. The remaining end of the barrel defines a muzzle at a free end 97 of the barrel.

The barrel 94 extends from the receiver 50, such as from the barrel adapter 60, to extend a free length of approximately 12 inches to 36 inches. That is, the barrel is unsupported for a length of approximately 12 inches to 36 inches. In certain configurations, the barrel length is between approximately 20 inches to 31 inches with one configuration having a barrel length of approximately 26 inches.

The term arrow 20 includes an elongate shaft 22 having an arrowhead such as a pointed or penetrating end. The arrow 20 typically includes fletching, however, it is understood the fletching is not required.

At least a portion of the shaft 22 of the arrow 20 is hollow and sized to slideably receive the barrel. As set forth above, for a barrel 94 having an outer diameter of approximately 0.354", the inner diameter of the hollow shaft 22 is approximately 0.314". The shaft 22 thus has an open end 23 at a rear end 26 of the arrow. The hollow length of the arrow 20 can be from approximately 25% to 95% of the overall length of the arrow.

The arrow 20 can have a variety of lengths from approximately 12 inches to approximately 36 inches. Depending on the construction of the arrow, the arrow 20 can have a weight from approximately 250 to approximately 450 grains.

Referring to FIGS. 4 and 5, at or adjacent to the rear end 26 of the shaft, an outside surface 28 of the arrow includes a bushing 30. In one configuration, the bushing 30 is selected to substantially resist deformation under a retention force applied by the gripping surface.

As seen in the FIGS. 4 and 5, the bushing 30 can include a tapered leading/trailing edge 32, 34 for facilitating locating the bushing under the retention force of the gripping surface.

To reduce the required adjustments of the collar 90 relative to the barrel adapter 60, it has been found advantageous to form the bushing 30 from a relatively rigid material such as steel, aluminum or a rigid polymer.

Thus, an arrow 20 for the arrow gun 10 for propelling the arrow by a compressed gas is provided, wherein the arrow has an elongate hollow shaft 22 extending along a length of the arrow; and a bushing 30 coupled to the shaft to define a portion of the outside surface of the shaft along at least a portion of the length of the arrow, the bushing 30 having a greater wear resistance than an adjacent portion of the shaft. The bushing 30 can define an outer surface of the arrow, and in select configurations, define a maximum diameter of the shaft. That is, the bushing 30 has a diameter greater than a shaft diameter.

In construction, the external threads 96 of the barrel 90 are engaged with the internal threads 66 of the barrel adapter 60. This connection fixedly seats or connects the barrel 20 to the barrel adapter 60.

The damping coupling 78 is the located within the control length 64 of the receiving recess 63 to extend in the damping annulus 75 between the barrel adapter 60 and the outside surface of the barrel 20. As seen in FIG. 5, the locking element, or ring 80, can be used to capture and retain the damping coupling.

The gripping surface 84 is then located in the seating groove 83 and the collar 90 engaged with the barrel adapter 60. As the collar 90 is longitudinally displaced relative to the barrel adapter 60, the axial force on the gripping surface 84 is changed and hence the amount of the gripping surface that projects into the control length 74 of the receiving recess 63 is changed.

As the gripping surface 84 is the surface that contacts the arrow 20, such as on the bushing 30, to resist movement of the arrow relative to the barrel adapter 60, the amount of retention force on the arrow can be varied and controlled by controlling the retention force imparted by the gripping surface through the amount of the gripping surface projecting into the retaining recess, which is set by the compression on the gripping surface applied by the collar 90 and the barrel adapter 60.

In one configuration, the bushing 30 of the arrow 20 defines a reproducible diameter against which the gripping surface 84 contacts and thus in conjunction with the gripping surface provides a reproducible and consistent retention force on the arrow. Thus, for each arrow 20 charged on the barrel 94, the constant sizing of the outer diameter of the bushing 30 in combination with the preset retention force from the gripping surface 84, the performance of the propelled arrow is within 10% for multiple shots.

The adjustment of the collar 90 relative to the barrel adapter 60 can be set during the manufacture of the gun 10, or can be subsequently set or adjusted, depending on intended operation of the gun.

In one configuration, the arrow 20 is configured to slideably receive the barrel 94, the arrow has a relatively small diameter, typically less than 0.5 inches and depending upon the material of the shaft can be 5/16", 11/32", and 23/64" for wooden shafts; 5/16" for carbon shafts with many options in larger and smaller diameters; aluminum shafts typically having a diameter of approximately 11/32", 21/64", 5/16" and 9/32" and fiberglass shafts having a diameter in the range of 5/16" or 1/4".

To accommodate these dimensions, the barrel 94 must by sized to be received with the longitudinal recess of the shaft 22. Thus, the barrel 20 has a smaller diameter which tends to increase vibration as the unsupported length increases. However, as the barrel length increases, the accuracy of the gun 10 increases. Therefore, it is desirable to increase the length of the barrel 20.

The damping coupling 78 is selected to inhibit vibration of the unsupported length of the barrel 20 relative to the barrel adapter 60. By reducing the vibration (movement of the barrel 20 relative to the barrel adapter 60), the accuracy of the gun can 10 be increased.

An advantage of the small bore barrel 20 is that compressed gas entering the barrel at the barrel adapter 60 acts on the arrow, sooner than the compressed gas would in a larger bore barrel.

The arrow weight, retention force from the gripping surface (via the coupler) and pressure of the compressed gas (motive gas pressure) are selected to provide a 350 grain arrow with a velocity of approximately 450 feet per second (fps) to 500 fps.

While the invention has been described in connection with several presently preferred embodiments thereof, those skilled in the art will appreciate that many modifications and changes may be made without departing from the true spirit and scope of the invention which accordingly is intended to be defined solely by the appended claims.

The invention claimed is:

1. An arrow gun using compressed gas to propel an arrow having a hollow portion, the arrow gun comprising:

(a) a receiver;

(b) an elongate barrel having a longitudinal axis, the barrel connected to the receiver at a fixed connection, the barrel having an outer diameter sized to be slidably received within the hollow portion of the arrow and terminating at a free end;

(c) a damping coupling between the receiver and the barrel, the damping coupling longitudinally spaced along the barrel from the fixed connection to be intermediate the fixed connection and the free end of the barrel; and (d) wherein the barrel has an unsupported length of approximately 12 inches to 36 inches between the damping coupling and the free end.

2. The arrow gun of claim 1, wherein the damping coupling is a resilient coupling.

3. The arrow gun of claim 1, wherein the damping coupling includes at least one resilient element contacting the receiver and an outside surface of the barrel.

4. The arrow gun of claim 1, wherein the receiver includes a barrel adapter having an aperture size to slidably receive a length of the barrel, the damping coupling extending between the barrel adapter and the barrel.

5. The arrow gun of claim 1, wherein the fixed connection connects the receiver to the barrel.

6. The arrow gun of claim 1, wherein the barrel has an outside diameter less than approximately 0.5 inches.

7. An arrow gun using compressed gas to propel an arrow having a hollow portion, the arrow gun comprising:

(a) a barrel sized to be received within the hollow portion of the arrow;

(b) a gripping surface having a first configuration exerting a first retention force on the arrow receiving the barrel within the hollow portion and a second configuration exerting a different second retention force on the arrow receiving the barrel within the hollow portion; and (c) a collar moveable relative to the barrel to dispose the gripping surface between the first configuration and the second configuration.

8. The arrow gun of claim 7, wherein the second retention force on the arrow is such that the arrow overcoming the second retention force has a kinetic energy of at least approximately 100 $ft^2$ $lbs/s^2$ in response to a firing pressure between approximately 500 psi and 5,000 psi.

9. The arrow gun of claim 7, wherein the second retention force on the arrow is such that the arrow overcoming the second retention force has a kinetic energy of at least approximately 100 $ft^2$ $lbs/s^2$ in response to a firing pressure between approximately 500 psi and 2,000 psi.

10. The arrow gun of claim 7, wherein the second retention force on the arrow is such that the arrow overcoming the second retention force has a velocity of at least approximately 350 feet per second to an approximately 350 grain arrow in response to a firing pressure of approximately 5,000 psi.

11. The arrow gun of claim 7, wherein the retention force acts on an outside surface of the arrow.

12. The arrow gun of claim 7, wherein the gripping surface is an elastic element.

13. The arrow gun of claim 7, wherein the gripping surface is compressible.

14. The arrow gun of claim 7, wherein the gripping surface is resilient.

15. The arrow gun of claim 7, further comprising a barrel adapter wherein the collar is moveable relative to the barrel adapter to dispose the gripping surface between the first configuration and the second configuration.

16. The arrow gun of claim 7, wherein the barrel has an outside diameter less than approximately 0.5 inches.

17. The arrow gun of claim 7, wherein the barrel has an unsupported length between approximately 12 inches to 36 inches.

* * * * *